United States Patent [19]

Fruchter et al.

[11] 4,430,120

[45] Feb. 7, 1984

[54] PROCESS FOR THE MANUFACTURE OF PURE METALLIC ALUMINUM FROM ALUMINUM ORES AND OTHER ALUMINUM-BEARING MATERIALS

[76] Inventors: Moshe Fruchter, 104 Hagalil Str., Haifa 32683; Anutza Moscovici, 11 Dov Hoz Str., Rechovot 76580, both of Israel

[21] Appl. No.: 286,518

[22] Filed: Jul. 24, 1981

[51] Int. Cl.[3] ..... C22B 21/02

[52] U.S. Cl. ..... 75/68 B; 75/10 R

[58] Field of Search ..... 75/68 R, 68 B, 113, 75/10 R

[56] References Cited

U.S. PATENT DOCUMENTS

| | | | |
|---|---|---|---|
| 3,856,508 | 12/1974 | Othmer | 75/68 B |
| 4,096,234 | 1/1978 | Martin et al. | 75/113 |
| 4,188,207 | 2/1980 | Adams, Jr. | 75/68 B |

*Primary Examiner*—M. J. Andrews

*Attorney, Agent, or Firm*—Schwartz, Jeffery, Schwaab, Mack, Blumenthal & Koch

[57] ABSTRACT

The present invention relates to a process for the manufacture of aluminum metal from aluminum ores, clays ashes, bauxites or wasted effluents containing aluminum. The process involves the following steps: (a) a homogeneous mixing of the aluminum-bearing material with a reducing agent, alkali metal chloride selected from sodium chloride and potassium chloride and mixtures thereof and optionally silica; (b) coking the mixture; (c) heating the mixture at a temperature in the range of 900° C. to 1200° C.; (d) reacting the mixture obtained at a temperature in the range of about 1200° C. to 1800° C., optionally in the presence of oxygen and additional energetic coke, obtaining aluminum monochloride gas and molten alkali metal silicate, and (e) rapid cooling of the aluminum monochloride and carbon monoxide at a temperature in the range of about 650° C to 800° C. with a molten sodium-aluminum chloride producing aluminum trichloride and pure aluminum metal.

The invention also relates to an electric blast furnace suitble for the manufacture of aluminum, possessing several rows of electrodes located at various distances, the heat being provided either by electric supply or by carbon combustion which takes place in the furnace. This type of furnace is characterized by its low energy consumption.

9 Claims, 1 Drawing Figure

Figure 1:
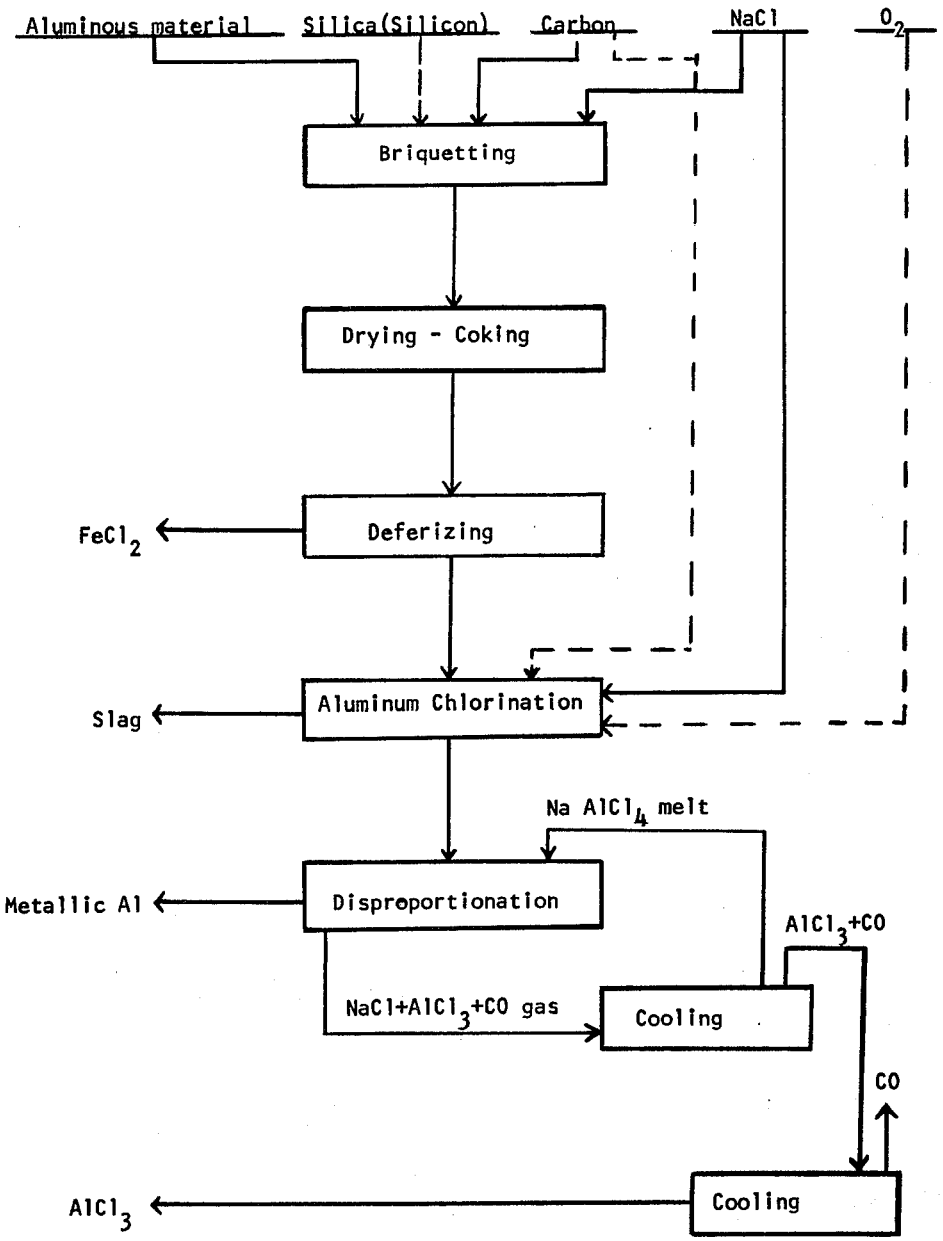

PROCESS FOR THE MANUFACTURE OF PURE METALLIC ALUMINUM FROM ALUMINUM ORES AND OTHER ALUMINUM-BEARING MATERIALS

The present invention relates to a process for the manufacture of pure metallic aluminum from aluminum ores and other aluminum-bearing materials.

Specifically, this invention relates to a process for the manufacture of pure metallic aluminum from aluminum-bearing materials by a chemical method at elevated temperatures.

The dominant method for the manufacture of aluminum metal is the Bayer-Hall process, which usually works out only high quality bauxites. The essence of this process is the electrolysis of pure alumina in a bath containing molten cryolite. Under the influence of the current, the oxygen in $Al_2O_3$ is evolved at the carbon anode, which is thereby burned, while the molten aluminum is deposited on the cathode.

The direct reduction of aluminum ores, containing oxides or silicates of aluminum, has been the subject of many investigations, reports and patents. The object of all these attempts was to provide a commercial method which would compete with the expensive Bayer-Hall process. Thus U.S. Pat. Nos. 3,607,221 and 3,758,290 suggest carbothermic reduction of alumina to metallic aluminum and U.S. Pat. Nos. 3,254,988 and 3,758,289 deal with $Al_2O_3$ reduction by silicon to arrive finally at partially purified Al—Si alloy.

A relatively new approach for aluminum extraction, is the use of aluminum chloride as the intermediary chemical product. Among this kind of process, the ALCOA and TOTH processes are the most developed. The ALCOA process is based on the electrolytical decomposition of $AlCl_3$ in a new type of electrolytic cell. The $AlCl_3$ is produced by direct chlorination of pure alumina.

The basis of the TOTH process is the exchange reaction between manganese metal and $AlCl_3$. The latter is obtained from clay in a reducing atmosphere by chlorination through recirculated chlorine. Another approach to aluminum extraction is based on U.S. Pat. No. 2,470,305, where the reduction-chlorination is carried out at high temperatures. Under these conditions, the gaseous phase consists of AlCl, which is stable at temperatures above 1200° C. and unstable below this temperature. Following a disproportionation reaction, the gases decompose into aluminum metal and $AlCl_3$. On the basis of the above approach, ALCAN developed a process, whereby the reduction and chlorination reactions are separate. In the first step of the process, the reduction of $Al_2O_3$ from bauxite takes place (at 2000° C.), according to the following reaction:

$$Al_2O_3.SiO_2+5C \rightleftarrows 2Al.Si+5CO \quad (1).$$

In a separate converter, the crude Al—Si alloy is reacted with preheated recycled $AlCl_3$ (at about 1300° C.), according to the reaction:

$$2Al.Si+AlCl_3 \rightleftarrows 3AlCl_{gas}+Si \quad (2a).$$

The hot gases are then cooled at 700° C. and decompose according to the disproportionation reaction:

$$3AlCl \rightleftarrows 2Al+AlCl_3 \quad (2b).$$

Some improvements in the above approach were described in U.S. Pat. Nos. 3,793,003 and 3,853,541, wherein reduction and chlorination are carried out in one furnace, with aluminum chloride or free chlorine as the chlorinating agent. The reducing agent used is carbon. In order to avoid any reaction between gaseous CO and gaseous AlCl (which are produced at a temperature range of between 1000° C. to 1500° C.), these gases are cooled to about 700° C. (in less than 5 seconds) by quenching with a molten salt mixture consisting of aluminum chloride and sodium chloride, thus forming pure aluminum metal and aluminum chloride. The aluminum obtained is recycled in the process as a chlorinating reagent, to react either with iron constituent, which as known, is always present with aluminum-bearing material (reaction 3a), or with alumina (resulting from either $Fe_2O_3$ chlorination or initially present in the raw material).

$$Fe_2O_3+AlCl_3 \rightleftarrows FeCl_3+Al_2O_3 \quad (3a)$$

$$Al_2O_3+3C+AlCl_3 \rightleftarrows 3AlCl+3CO \quad (3b)$$

A very recent patent, U.S. Pat. No. 4,188,207, based on the same approach, describes the manufacture of pure aluminum metal from aluminum-bearing materials, using a reducing agent at a temperature of above 1600° C., and using calcium chloride as the chloridizing agent. The calcium chloride appears to be the preferred salt from among the nonvolatile stable alkaline-earth chlorides claimed: $BaCl_2$, $SrCl_2$ and $MgCl_2$. The main disadvantage of this process seems to be connected with the slow reaction rate involved between the molten salt and the solid aluminum-bearing material. Chlorides of sodium, potassium and lithium are mentioned specifically as unsuitable, being characterized as too volatile and too stable.

Although the above review of the state of the art indicates that there have been some achievements in obtaining pure aluminum metal directly from ores through chlorination and AlCl disproportionation, it appears that there is still a great need for a simple, attractive and inexpensive process for the production of aluminum metal from aluminum-bearing materials by chemical means, particularly in these days when energy expenses are so high.

It is an object of the present invention to provide a simple process for the manufacture of pure aluminum metal from aluminum-bearing materials, using alkali metal chlorides as the chloridizing agent. It is another object to provide a simple process for the manufacture of pure aluminum metal from aluminum-bearing materials, whereby alkali metal silicates and aluminum trichloride are co-produced.

Yet another object of the present invention is to provide a new type of furnace which requires minimal energy consumption and also deals more effectively with the corrosiveness of the hot gases.

The invention consists of a process for the manufacture of pure aluminum metal from aluminum-bearing materials, which comprises the following steps:

(a) homogeneous mixing of the aluminum-bearing materials with a reducing agent, an alkali metal chloride selected from the group consisting of sodium chloride, potassium chloride, lithium chloride, or mixtures thereof and optionally, silica;

(b) drying the homogeneous mixture in a furnace at a temperature which is sufficient to cause coking of said mixture;

(c) heating the mixture in a furnace at a temperature in the range of 900° C. to 1200° C. whereby the gaseous iron chloride produced is volatilized;

(d) reacting the iron-free aluminum-bearing material with reducing agent and said alkali metal chloride, optionally, with additional oxygen and additional energetic coke, by heating at a temperature in the range of 1200°-1800° C., resulting in aluminum monochloride gas and molten alkali silicate; and (e) rapid cooling of the aluminum monochloride gas in a molten mixture of sodium chloride and aluminum trichloride, whereby a disproportionation into volatile aluminum trichloride and pure aluminum metal occurs, said products being subsequently separated.

The process is very simple to carry out, operations of both reduction and chlorination being performed as a whole, in the same furnace. The purity of the metallic aluminum product resulting from the process of the present invention, exceeds that from the usual Hall-Heroult electrolysis process. In addition to the metallic aluminum, valuable aluminum trichloride and alkali metal silicates are obtained as by-products, according to the reactions ((4a) and (4b)).

$$Al_2O_3+2SiO_2+2C+2NaCl \rightleftharpoons 2AlCl+2CO+Na_2O.2SiO_2 \quad (4a)$$

The required amount of silica is provided either from the silica contained in the original aluminum-bearing material, or introduced as such to the raw material, or by elemental silicon introduced as a reducing agent.

$$Al_2O_3+Si+2NaCl=Na_2O.SiO_2 \quad (4b).$$

When clays are used as the raw material, their silica content (about 40% to 50% $SiO_2$) is sufficient and no additional silica is required.

The velocity of these reactions is very much increased by contacting the solid components of the charge with NaCl vapors, produced by heating the salt at 1200°-1400° C.

As aluminum-bearing materials, any aluminum ore (which generally contains various amounts of iron and silica), clays, coal ashes, bauxites can be successfully utilized. Aluminum metal scraps, aluminum alloys, or any other wasted effluent which contains aluminum, such as slags and red mud, can also be used.

When the used raw material is free of $SiO_2$ or has a $SiO_2$:$Al_2O_3$ molar ratio of less than 1, a respective quantity of $SiO_2$, such as sand, must be added. It is advisable, in this case, to replace part (or all) of it by elemental silicon, which will act at the same time as a reducing agent, instead of carbon.

The iron present is eliminated as iron chloride in step (c), after its formation according to reaction (5):

$$Fe_2O_3+2SiO_2+C+4NaCl \rightleftharpoons 2FeCl_2+CO+2Na_2O.SiO_2 \quad (5)$$

According to one embodiment of the process, the chlorination of the aluminum-bearing material is performed by the vapors of the alkali metal chloride salt, in the presence of silica and a reducing agent such as carbon or elemental silicon (reactions 4a and 4b).

According to another embodiment, the chlorination of the aluminum-bearing material is performed by gaseous chlorine, obtained in-situ in the same step (d) from the alkali metal chloride salt and oxygen (reaction 6):

$$2NaCl+SiO_2+\tfrac{1}{2}O_2 \rightleftharpoons Cl_2+Na_2O.SiO_2 \quad (6).$$

The gaseous chlorine obtained will react with the alumina according to one of the following reduction-chlorination reactions, depending on the reducing agent utilized:

$$Al_2O_3+Cl_2+3C \rightleftharpoons 2AlCl+3CO \quad (7a).$$

$$2Al_2O_3+2Cl_2+3Si \rightleftharpoons 4AlCl+3SiO_2 \quad (7b).$$

The first step—to obtain a homogeneous solid mixture of alumina raw material with the solid reducing agent—is extremely important for the entire process; an intimate blending being absolutely required. It is preferable to obtain the mixture in the form of pellets or briquettes which will also assist in further handling and diminish loss of pulverulent feed. Generally, the aluminum-bearing material and the solid reduction agent should be of particle size in the range of 60 to 200 microns, although larger sizes may also be used, up to a size of 100 mm, in which case the reducing agent must be in gaseous form (e.g. carbon monoxide). The particulate mass is subsequently dried at a temperature which is high enough to drive off all free and combined water. When briquettes are utilized, coal tar is used as a binder and drying is accompanied by a coking process.

In FIG. 1 (attached), a schematic block diagram of the process is presented, including the preferred step of briquetting, which as previously mentioned, is not absolutely required.

The quantity of reducing agent to be added in the briquette mixture corresponds to reactions (5), (4a) and (4b), while the quantity of chlorination agent is only according to reaction (5). The resulting iron-free briquette is ready for the next step, $Al_2O_3$ reduction-chlorination, (reactions (4a) and (4b)), in which it must contact and react with the gaseous chlorination agent (chlorine and/or alkali metal chloride).

In step (c) the hot briquettes are introduced into a furnace of the usual indirect heating type, wherein iron chloride is formed according to reaction (5) and eliminated as gas. The temperature in this furnace is generally in the range of 900°-1300° C. and preferably in the range of 1100°-1200° C.

Stage (d), chlorinating the iron-free aluminum-bearing materials, is the most important step, whereby the aluminum constituent is transformed into aluminum chloride in the presence of alkali metal chloride and a reducing agent (coke or silicon) with or without oxygen. At the relatively high temperatures in the electric blast furnace (in the range of 1400°-1800° C.), chlorination occurs simultaneously with the reduction of the aluminum-bearing material), resulting in aluminum monochloride, along with carbon monoxide and alkali metal silicate. These reactions are in accordance with the equations (4a), (4b) and/or equations (6) and (7a), (7b), depending on the conditions and the reducing agent used. The alkali metal silicate is withdrawn as a molten slag, while the gaseous mixture of carbon monoxide and aluminum monochloride is conveyed to a special splash tower where it is quenched with molten salt consisting of sodium chloride and aluminum chloride. The quantity of the quenching melt should be sufficient to assure the rapid cooling of the hot gases to about 800° C., in order to avoid a possible back reaction according to equation (7a).

The quenching medium also absorbs the aluminum trichloride formed in the disproportionation reaction, while pure metal aluminum is separated out. After the aluminum separation, the exhausted gases are cooled to about 250° C., in order to condense vapors of the quenching salt, which is then recycled to the quenching tower. According to the preferred embodiment, the uncondensed $AlCl_3$, which is mixed with CO in the cooled gases, can be separated by supplementary cooling at 100° C. The substantially pure carbon monoxide gas can be utilized as a heating agent in the initial steps of the process where indirect heating is required. The $AlCl_3$ so separated, is a valuable by-product by itself, or it can be further processed by oxidizing with oxygen to obtain pure chlorine gas according to the following reaction:

$$2AlCl_3+3/2O_2 \rightleftarrows Al_2O_3+3Cl_2 \quad (8).$$

This is another advantage of the process described in the present invention, whose flexibility enables to obtain the desired co-product according to the specific requirements for use.

One of the most important features of the present invention is the utilization of alkali metal chlorides (due to their volatility and great reactivity at the mentioned elevated temperatures) for either the direct chlorination of the aluminum-bearing materials, or for the generation of chlorine for the same purpose. The alkali metal chlorides most preferred are sodium chloride and potassium chloride. The former is particularly suitable due to its lower cost. Of course, it goes without saying that mixtures of said sodium and potassium chlorides, which appear as natural minerals (in the form of sylvinite), or as double salts of the alkali metal chlorides with other alkali earth metal chlorides, in their natural form (such as carnallite or double salt of sodium chloride with calcium chloride) can also be successfully utilized. Only the alkali metal chlorides, of all the above chlorides, can participate in the chlorination reaction. This of course, is another advantage of the present invention, since the chlorination agent itself is an inexpensive natural raw material which exists abundantly in many places.

The present invention also provides a novel type of equipment, the so-called electric blast furnace, which can be heated by electricity and/or by the hot gases resulting from burning coke with oxygen. Due to the high endothermicity of the process, the equipment consumes a great deal of energy, which should be supplied in such a manner as to be most efficiently utilized. The electric energy is supplied by lateral electrodes inserted into the furnace, which use the internal charge of the furnace as electric resistance. The amount of heat can be adjusted by varying the voltage applied to the rows of electrodes situated at several levels into the furnace; the upper row being located in that zone where the gases leave the furnace (zone I), so that a temperature in the range of 1400° to 1800° C. will prevail. Another row of electrodes is situated approximative in the middle of the furnace (zone II), to assure a temperature in this zone in the range of 1200°-1500° C., while the lower row of electrodes (zone III), should be at the bottom, just above the slag zone, in order to keep the slag in a molten state (the temperature prevailing there being in the range of 1100°-1200° C.). In order to increase the conductibility of the charge, especially in the high and middle zones, it is advisable to charge some preheated coke together with the briquettes, preferably at a maximum temperature (above 1000° C.). The mixture of coke and briquettes will result in a very porous and resistant medium able to transmit the electric current and also to allow for the passage of gases, which may then react with the components of the briquettes. In order to minimize the use of electric energy in particular in the lower part of the furnace, coke may be used as an alternative energy source. This is achieved by blowing supplementary oxygen through the tuyères and continuously supplying the coke at the top of the furnace, so as to replace the carbon which is burnt out according to the reaction:

$$C+\tfrac{1}{2}O_2 \rightarrow CO \quad (9).$$

In the normal operation of the furnace, the deferized briquettes, containing the aluminum-bearing material mixed with the amount of reducing agent according to the equations (4a), (4b) or (7a) and (7b), are introduced in the upper zone of the furnace, while the oxygen and/or chloridizing agent are blown together through the tuyères.

The operation of the electric blast furnace, according to the present invention, enables control of the thermal balance, combining both the electric energy and the thermal energy provided by the coke burning. The optimal solution will be selected based on economical and technical considerations, also taking into account the impact of the chosen solution in the gas disproportionation reaction, wherein the volume of gases becomes greater with the coke combustion.

Summing up, the process according to the present invention, can be carried out via one of the following three approaches using various combinations of energy-type supplied and of the chloridizing agent (alkali metal chloride or chlorine).

(1) The AlCl formation is based only on reactions (4a) and (4b), electric energy being the only source for the thermal balance. The briquettes are composed of at least two moles of carbon, or 1 atom of silicon, for each mole of $Al_2O_3$, and at least two moles of NaCl is introduced through the tuyères of the furnace. The electric heating of the third zone maintains a temperature in the range of 1200°-1400° C., so that the NaCl vapors are formed at the rate corresponding to that of reactions (4a) and (4b), which take place in the second and first zone. Molten sodium silicate percolates through the hot coke and accumulates at the bottom of the furnace, from which it is periodically removed. The volume ratio Al:CO in the gaseous phase, depends on the quantity of silicon used to replace the carbon as a reducing agent, being at least 1:1 when carbon only is used, or 1:0 when silicon only is used (no carbon oxide in gases). Intermediate ratios result when a carbon:silicon mixture is used as the reducing agent.

(2) According to a second approach, the AlCl formation is based on reactions (6), (7a) and (7b), wherein the chlorination is effected by gaseous chlorine, the thermal balance being maintained by electric energy supply only. The briquettes fed to the furnace contain three moles of carbon for each mole of $Al_2O_3$ (or a correspondingly reduced ratio when carbon is replaced by silicon), and at the tuyères a mixture of oxygen and powdered NaCl is blown-in, in order to react according to reaction (6). The reaction between the blown-in components and the silica introduced with the charge, occurs in the lower-oxidant zone of the furnace, while the reaction of AlCl formation with the eliberation of silica occurs in the upper zones, according to reactions (7a) and (7b). Some silicon chloride may also be formed in the mixed zone between the second and third zones, according to the following reaction:

$$SiO_2+2C+2Cl_2 \rightleftharpoons SiCl_4+2CO \quad (10).$$

However, this will not disturb the overall process of the present invention since in the upper part of the third zone there is a change reaction between said silicon chloride and alumina, according to the following:

$$2Al_2O_3+SiCl_4+4C \rightleftharpoons 4AlCl+SiO_2+4CO \quad (11).$$

The silica present in the briquettes (during their decomposition) descends to the tuyères zone to participate in reaction (6). The gases, consisting of a mixture of AlCl and CO (about 2:3 volume ratio) are collected at the upper part of the furnace and are evacuated to the quenching tower.

As in the first case, carbon used as the reducing agent, can be replaced by silicon, in order to increase the AlCl:CO ratio in the gases. If all 3 moles of carbon are replaced by $1\frac{1}{2}$ moles of silicon, the final gas will consist of pure AlCl gas. It is also possible to vary the AlCl:CO volume ratio between 2:3 and 1:0 (between 40% and B 100% vol. of AlCl in gas mixture).

(3) In the third approach, the AlCl formation is also based on reactions (6), (7a) and (7b)—the chlorination being realized by gaseous chlorine—but electric energy is partially or totally replaced by thermal energy evolved as in reaction (9). Thus, carbon will not only be a reductor, but also a thermal reagent which will burn with the oxygen blown into the furnace, so as to maintain the temperature and the reducing atmosphere in its upper zones. The ratio between the constituents of the gas (AlCl and CO) will depend on the amount of coke burned in the furnace, and is directly related to the quantity of oxygen blown in. As an indicative figure, if all the energy required is to be supplied by burning the coke, it is necessary that about seven moles of carbon be burned out per mole of alumina, in addition to the carbon used for $Al_2O_3$ reduction, and in this case, the AlCl concentration will only be about 15% (by volume). If the reducing agent consists only of silicon, the concentration of AlCl will rise to about 22% (by volume).

Although the invention will be described in the following examples in connection with certain preferred embodiments, it should be understood that it is not the intention to limit the invention to only these particular embodiments. On the contrary, it is intended to cover all the alternatives, modifications and equivalents, which may be included within the scope of the invention, as defined by the appended claims. Thus the following examples, which include preferred embodiments, will serve to illustrate the practice of the invention. It should be understood that the particulars described below are examples only, for purposes of illustrative discussion, and are presented in order to provide what is believed to be the most useful and readily understood description of procedures, as well as of the principles and conceptual aspects of the invention. In the Examples below, the precentages are expressed by weight unless other wise stated.

EXAMPLE 1

A mixture consisting of ground clay (100 mesh), containing 30% $Al_2O_3$, 10% $Fe_2O_3$ and 45% $SiO_2$, coke and NaCl, is briquetted in the presence of 3% pitch. The components of the briquettes are balanced as follows: for each mole of $Fe_2O_3$ in clay, 4 moles of NaCl and 1 mole of carbon (necessary for the deferization) and 2 moles of carbon for each mole of $Al_2O_3$ in clay (necessary for the second operation of alumina reduction). The briquettes are coked at 850° C. for one and a half hours. An excess of about 10% of the added reactants is necessary to cover the CO, $CO_2$, $H_2$ and HCl gases which evolved together with the water vapors in the coking process. After coking, the briquettes are heated to about 1100° C., whereby deferization occurs, in accordance with equation (5). This operation is maintained for about one hour, in order to ensure the complete elimination of the iron component from the briquettes. The iron-free briquettes are introduced into the second zone of a two-zone electric tube furnace, while NaCl is introduced into the first zone, in order to be volatilized at a temperature in the range of about 1100°-1400° C. There should be a ratio of at least 2 moles of NaCl for each mole of alumina. The temperature in the first zone is controlled so as to assure that the evaporation of the sodium chloride takes place according to the rate of the reaction in the second zone, where the temperature is maintained at about 1500° C. During the reaction in the second zone, aluminum monochloride evolves, together with carbon monoxide from the furnace, leaving a melt of sodium silicate. After the quenching of the above gas-mixture, 4/3 moles of metalic aluminum and $\frac{2}{3}$ moles of gaseous $AlCl_3$ from each mole of $Al_2O_3$ can be obtained.

EXAMPLE 2

In this experiment, the chlorination of the aluminum-bearing material is carried out by gaseous chlorine obtained in a first step by the oxidation of sodium chloride, using the same two-zone electric furnace. Briquettes, similar to those in Example 1, are prepared adding one more mole of carbon to each mole of alumina in the clay, in order to satisfy reaction (7a). Sodium chloride and silica (in a 2:1 mole ratio) are introduced in the first zone, which is heated to about 1200° C., and the second zone is heated to about 1500°, while oxygen is blown into the first zone. In order to ensure a complete reaction of the oxygen introduced into the furnace (in order to satisfy reactions 6 and 7a), an excess of about 200% of $NaCl+SiO_2$ mixture is necessary. The AlCl+CO mixed gases contain about 40% AlCl and after quenching, 4/3 moles of metallic aluminum and $\frac{2}{3}$ moles of $AlCl_3$ for each $Al_2O_3$ mole can be obtained.

EXAMPLE 3

In this experiment, the chlorination of the aluminum-bearing material is carried out by gaseous chlorine (generated according to equation (6)—oxidation of NaCl through gas oxygen). Briquettes, similar to those prepared in Example 2, are introduced into a three-zone electric tube furnace. The first and third zones have the same purpose as in the previous experiment, while the intermediate zone, filled with lumps of coke, is heated to a temperature in the range of 1200°-1500° C. The oxygen blown into the first zone will react partially to generate chlorine (no $NaCl+SiO_2$ mixture excess is necessary), and the balance of the oxygen will react in the second zone to generate CO. The supplementary CO in the mixed gas which comes out of the furnace, can be controlled by the supplementary oxygen introduced in addition to the required amount necessary for sodium chloride oxidation. The quantity of supplementary oxygen is maintained in an excess of up to 3.5 moles for each mole of alumina, so as to assure a minimum ratio of 1:5 moles of AlCl to CO in the exhausted gases. After quenching, about 4/3 moles of metallic aluminum and $\frac{2}{3}$ moles of $AlCl_3$ for each $Al_2O_3$ mole, can be obtained.

EXAMPLE 4

A mixture consisting of ground, high-calcined, low-silica bauxite, silicon and NaCl is briquetted and dried at about 200° C. For each mole of $Fe_2O_3$ in the bauxite, 4 moles of NaCl and $\frac{1}{2}$ mole of silicon are added, together with a supplementary 1 mole of silicon for each mole of $Al_2O_3$.

All the operations, including the deferization and AlCl formation, are similar to those in Example 1, as are the final products obtained.

We claim:

1. A process for the manufacture of pure aluminum metal from aluminum-bearing materials, comprising the following steps:

(a) homogeneously mixing the aluminum-bearing materials with a reducing agent, a chloridizing agent consisting essentially of an alkali metal chloride selected from the group consisting of sodium chloride, potassium chloride, lithium chloride and mixtures thereof, and optionally silica;

(b) drying the homogeneous mixture in a furnace at a temperature sufficient to cause coking of said mixture;

(c) heating the mixture in a furnace, to a temperature is the range of about 900° C. to 1200° C., whereby iron chloride is formed and volatilized;

(d) reacting the iron-free aluminum-bearing materials with said alkali metal chloride and reducing agent, optionally, oxygen and additional energetic coke, by heating to a temperature in the range of about 1200° C.–1800° C., resulting in aluminum monochloride gas and molten alkali metal silicate and, (e) rapidly cooling the aluminum monochloride-carbon monoxide mixed gas to about 650°–800° C., with a molten sodium-aluminum chloride mixture, whereby a disproportionation into volatile aluminum trichloride and pure aluminum metal occurs, and subsequently separating said products.

2. A process for the manufacture of pure aluminum metal according to claim 1, wherein said aluminum-bearing material is selected from aluminum ores, clays, coal ashes, bauxites or wasted effluents which contain aluminum, such as slags, red mud or aluminum alloy scraps.

3. A process according to claim 1, wherein the reducing agent consists of carbon, silicon, or their compounds possessing reducing properties, selected from the group consisting of carbon monoxide, carbon monoxide chloride, calcium carbide, silicon carbide, calcium silicide or combinations thereof.

4. A process according to claim 1, whereby the homogeneous mixture is fed into the furnace in the form of briquettes.

5. A process according to claim 1, whereby after step (e), a further cooling of the mixture of $AlCl_3$ and CO to about 100° C. is carried out in order to separate any uncondensed $AlCl_3$.

6. A process according to claim 1, whereby in step (d), the chlorination of aluminum oxide from the iron-free aluminum-bearing material, is carried out by vapors of the metal alkali chlorides.

7. A process according to claim 1, whereby in step (d) chlorine is first obtained by the oxidation of the metal alkali chloride in the presence of silica at 1100°–1400° C., and subsequently reacts with the aluminum oxide in the iron-free aluminum-bearing material, to obtain aluminum monochloride gas at 1400°–1800° C.

8. A process according to claim 1, whereby a aluminum silicate is obtained as by-product.

9. A process according to claim 1, whereby the chlorine of the chloridizing agent is reclaimed as a final valuable by-product in the form of aluminum trichloride.

* * * * *